US007401554B2

(12) United States Patent
Zimich et al.

(10) Patent No.: US 7,401,554 B2
(45) Date of Patent: Jul. 22, 2008

(54) METHOD AND APPARATUS FOR CHANGING PRINTING LENGTH ON A PRINTING PRESS

(75) Inventors: Dan Zimich, Westchester, IL (US); Dan Machaj, Romeoville, IL (US)

(73) Assignee: Goss International Corporation, Bolingbrook, IL (US)

( * ) Notice: Subject to any disclaimer, the term of this patent is extended or adjusted under 35 U.S.C. 154(b) by 107 days.

(21) Appl. No.: 11/379,936

(22) Filed: Apr. 24, 2006

(65) Prior Publication Data

US 2006/0185545 A1 Aug. 24, 2006

Related U.S. Application Data

(63) Continuation of application No. 10/795,173, filed on Mar. 5, 2004, now Pat. No. 7,032,515.

(60) Provisional application No. 60/452,386, filed on Mar. 6, 2003.

(51) Int. Cl.
*B41F 1/28* (2006.01)

(52) U.S. Cl. ..... 101/480; 101/216; 101/479

(58) Field of Classification Search ..... 101/216, 101/217, 479, 480
See application file for complete search history.

(56) References Cited

U.S. PATENT DOCUMENTS 3,470,816 A * 10/1969 Langer et al. ..... 101/216
4,953,462 A * 9/1990 Krober ..... 101/216
5,074,205 A * 12/1991 Morgan ..... 101/181
RE33,944 E * 6/1992 Knauer ..... 101/216
5,584,243 A * 12/1996 Kern ..... 101/479
5,746,132 A * 5/1998 Parks et al. ..... 101/483
5,832,829 A * 11/1998 Kolbe et al. ..... 101/352.01
5,868,071 A * 2/1999 Niemiro et al. ..... 101/218
6,318,257 B1 * 11/2001 Niemiro et al. ..... 101/212
6,343,547 B1 * 2/2002 Callahan et al. ..... 101/216
7,032,515 B2 * 4/2006 Zimich et al. ..... 101/480

FOREIGN PATENT DOCUMENTS

DE 41 04 209 A1 8/1992

* cited by examiner

*Primary Examiner*—Daniel J. Colilla
*Assistant Examiner*—Kevin D Williams
(74) *Attorney, Agent, or Firm*—Marshall, Gerstein & Borun

(57) ABSTRACT

To modify an existing printing press from its original length/cut off to a different cut off, a sub-frame may be mounted on an existing frame of a printing press. The sub-frame permits the relocation of bearing supports for various printing cylinders, such as, for example, the plate cylinders and blanket cylinders. In addition to mounting the sub-frame on the existing frame, new plate and blanket cylinders having different sizes than the plate and blanket cylinders used in the existing printing press may be mounted in the sub-frame to provide different printing lengths/cut offs. Suitable sleeves, such as the eccentric mounting sleeves may be provided as necessary in order to mount the cylinders to the sub-frame.

14 Claims, 2 Drawing Sheets

METHOD AND APPARATUS FOR CHANGING PRINTING LENGTH ON A PRINTING PRESS

RELATED APPLICATIONS

This application claims priority from U.S. Non-Provisional Application Ser. No. 10/795,173, filed Mar. 5, 2004, now U.S. Pat. No. 7,032,515, which in turn claims priority from Provisional Application Ser. No. 60/452,386, filed Mar. 6, 2003.

FIELD OF THE DISCLOSURE

The present disclosure relates to printing presses and, more particularly, to a method and apparatus for changing the printing length/cutoff of an existing printing press to a new printing length/cutoff.

BACKGROUND OF THE DISCLOSURE

In many large scale printing presses one of many factors that affect overall cost is the length of the printing operation, termed the printing length or cutoff. For example, a printing press having a relatively long printing length may require significantly more paper than a press with a shorter printing length. The additional paper required impacts the operational cost of the printing press, which ultimately has an effect on the competitiveness of the printing operation. It is known that certain printing presses may be replaced with more modern and cost-effective printing presses or with presses having a shorter cutoff. However, it is also known that the wholesale replacement of a printing press involves, at the very least, substantial capital expenditures and the incursion of significant labor costs, which costs may not be recovered for a significant length of time.

DETAILED DESCRIPTION

Figure 1:
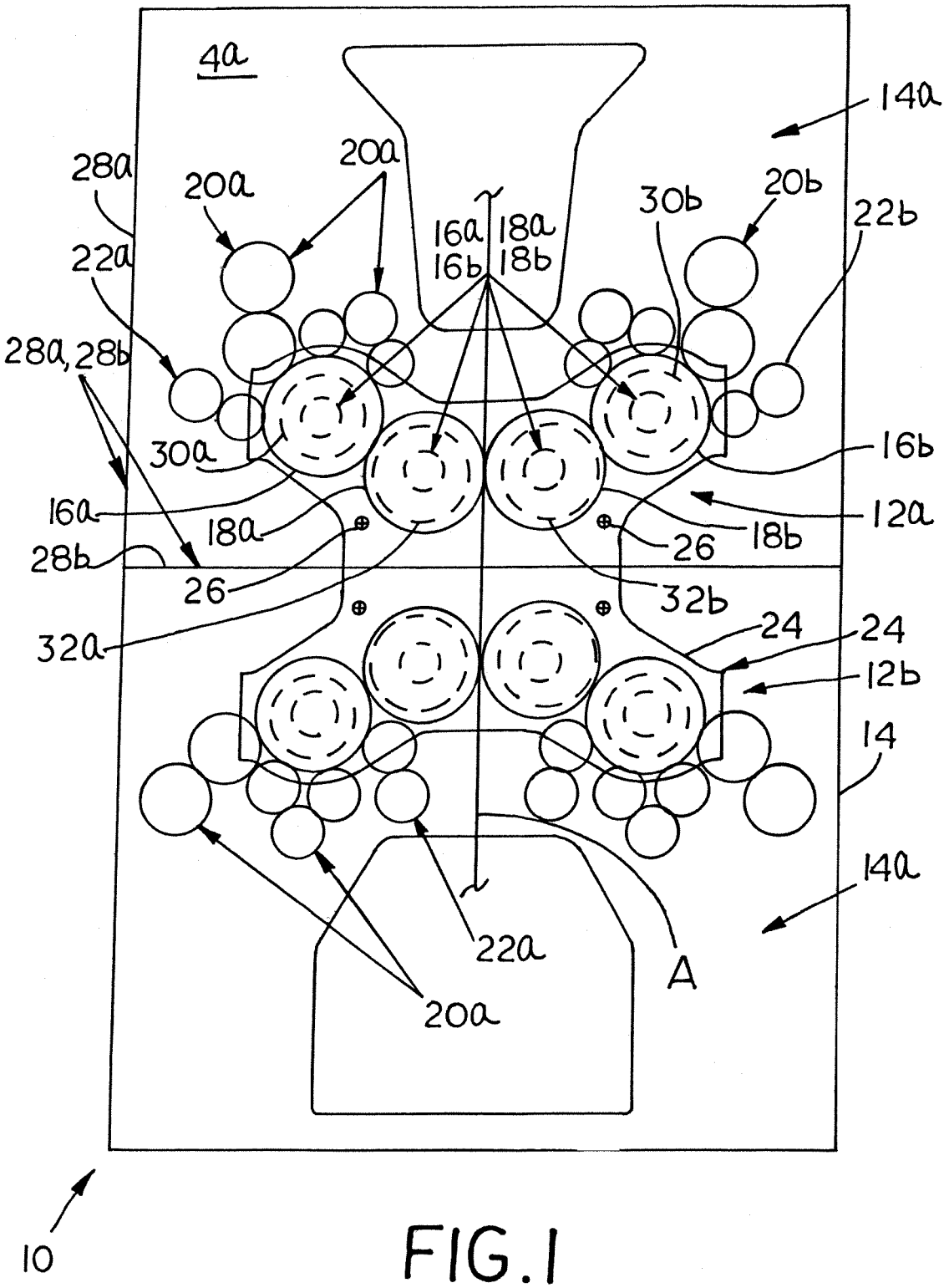
FIG. 1 is an elevational view of a printing station in a printing press having installed thereon an apparatus for changing the printing length/cutoff of the printing press assembled in accordance with the teachings of the present disclosure.

Referring now to FIG. 1, a printing press 10 is shown. It will be understood that the printing press 10 may include a plurality of printing stations, however only a pair of printing stations 12*a* and 12*b* are shown. The printing press 10 includes a frame 14 which generally supports a number of printing cylinders, components, systems, and subsystems to be discussed below that form a part of the printing operation.

Figure 2:
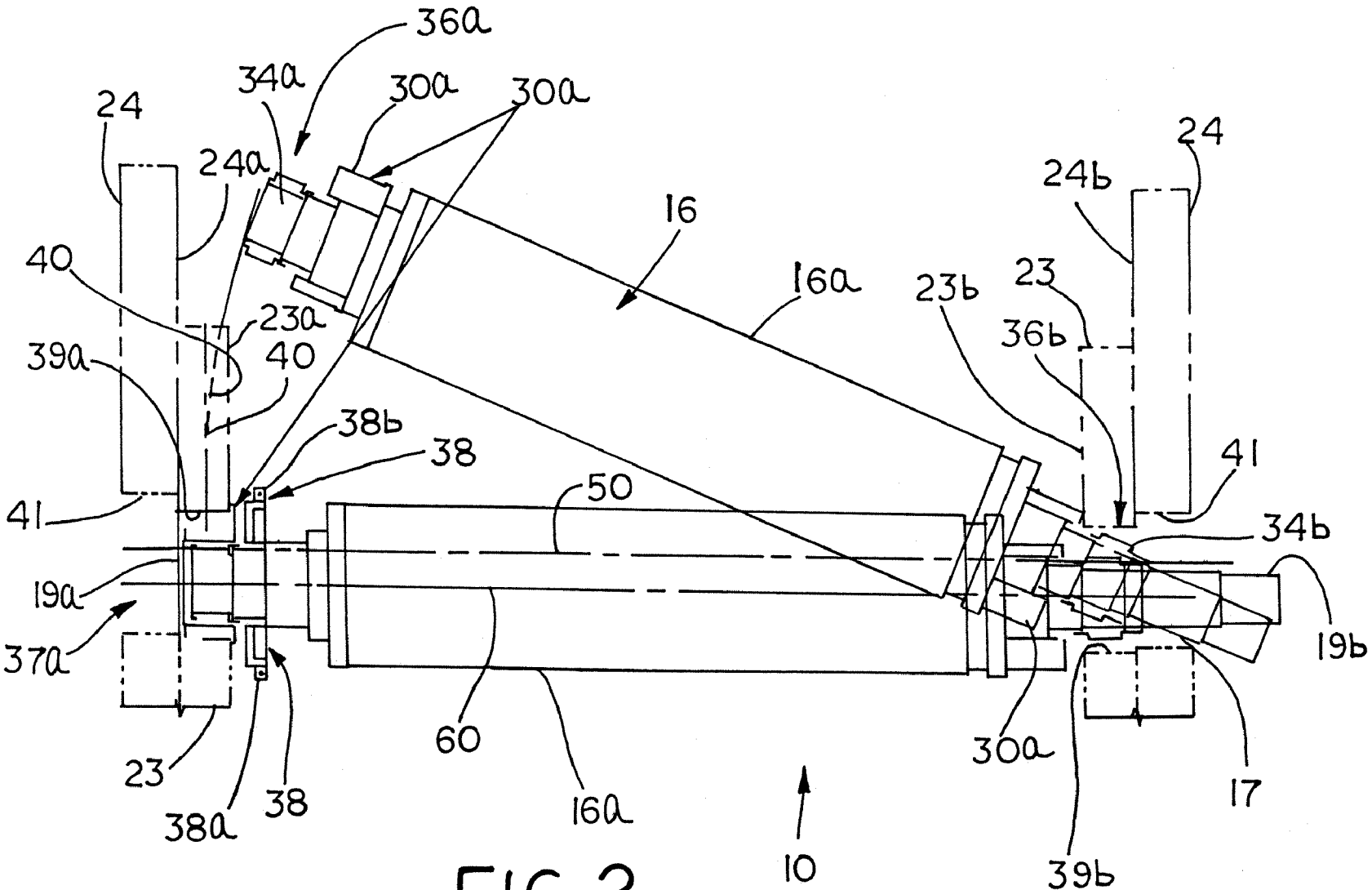
FIG. 2 is a fragmentary top plan view illustrating an exemplary manner by which a cylinder may be mounted to and installed or removed from an exemplary sub-frame attached to the existing frame of the printing press.

Referring to FIGS. 1 and 2, the frame 14 typically includes a pair of spaced apart sides 14*a* and 14*b*. Each side 14*a* and 14*b* may include a number of bores 37*a* and 37*b*, respectively. Each pair of the bores 37*a* and 37*b* have a common bore axis 50 to support a print cylinder. The printing press 10 further includes a sub-frame 24 that similarly includes a pair of spaced apart sides 24*a* and 24*b*. Each side 24*a* and 24*b* may include a number of bores 39*a* and 39*b*, respectively. Each pair of the bores 39*a* and 39*b* have a common bore axis 60 to support a print cylinder.

The bores 37*a* and 37*b* of the frame 14 are positioned on the frame relative to each other to provide operational coupling of print cylinders that have a first print length. The bores 39*a* and 39*b* of the sub-frame 24 are positioned on the sub-frame relative to each other to provide operational coupling of print cylinders that have a different print length than the first print length, which will be referred to as the second print length. As shown in FIG. 2, when the sub-frame 24 is mounted to the frame 14, the bores 39*a* and 39*b* of the sub-frame 24 may non-concentrically align with the bores 37*a* and 37*b* of the frame 14. In other words, the common bore axis 50 of the frame 14 and the common bore axis of the sub-frame 60 may not align when the sub-frame 24 is mounted to the frame 14. Therefore, as will be described in the following, by mounting the sub-frame 24 to the frame 14, the printing press 10 can be converted from having the first print length to the second print length.

The sub-frame 24 is mounted to the frame 14 in any suitable manner so that the bores 39*a* and 39*b* of the sub-frame 24 properly align with the bores 37*a* and 37*b* of the frame 14 as described above and as will be described in detail below. The frame 14 and/or the sub-frame 24 may include a number of reference lines, surfaces, projections, or the like that provide the proper aligning of the sub-frame 24 and the frame 14. For example, each of the frame sides 14*a* and 14*b* can include a plurality of dowels (not shown) that receive a corresponding number of apertures on the sub-frame sides 24*a* and 24*b*, respectively, to properly align the sub-frame 24 with the frame 14. In another example, each of the frame sides 14*a* and 14*b* can include a shallow depression (not shown) that is about the size of each of the sub-frame sides 24*a* and 24*b*. Accordingly, each sub-frame side 24*a* and 24*b* can be placed in the a corresponding depression for proper alignment with the frame sides 14*a* and 14*b*, respectively. In the disclosed example, the frame 14 includes or may otherwise be provided with one or more datum surfaces 28*a*, 28*b*. The datum surface 28*a* is generally vertical, while the datum surface 28*b* is generally horizontal. According to the disclosed example, the datum surfaces 28*a* and 28*b* may be used in order to properly vertically and horizontally align the sub-frame 24 relative to the frame 14 of the printing press 10.

Once each of the sub-frame sides 24*a* and 24*b* are aligned with the frame sides 14*a* and 14*b*, the sub-frame sides 24*a* and 24*b* can be securely fastened to the frame sides 14*a* and 14*b* with bolts 26, pins (not shown), or other types of fasteners. One of ordinary skill in the art will readily recognize that the bolts 26 and a corresponding number of apertures in the frame 14 and/or the sub-frame 24 that support the bolts 26 can also be used to align the sub-frame sides 24*a*, 24*b* with the frame sides 14*a*, 14*b*.

Referring to FIG. 1, the printing station 12*a* includes a pair of plate cylinders 16*a* and 16*b* and a pair of blanket cylinders 18*a* and 18*b*, which my be generally and collectively referred to herein as printing cylinders. The plate cylinders 16*a* and 16*b* and the blanket cylinders 18*a* and 18*b* straddle a path A along which the paper web (not shown) travels. The printing station 12*a* also includes an ink roller train 20*a*, which in the disclosed example consists of five individual rollers, and a dampening system 22*a*, which in the disclosed example consists of two individual rollers. The ink roller train 20*a* and the dampening system 22*a* are associated with the plate cylinder 16*a* and the blanket cylinder 18*a*. Similarly, the printing station 12*b* includes an ink roller train 20*b*, which in the disclosed example includes five individual rollers, and also includes a dampening system 22*b*, which in the disclosed example includes two individual rollers.

The ink roller train 20*b* and the dampening system 22*b* are associated with the plate cylinder 16*b* and the blanket cylinder 18*b*. It will be understood that the precise details of the ink roller trains 20*a*, 20*b* and the dampening systems 22*a* and 22*b* may vary in accordance with the requirements of any given printing press. Similarly, it will be understood that the printing press 10 may include additional components (no shown) which are known to those of skill in the art. Also, the printing station 12*b* may be substantially similar to the printing station 12*a* described above, and therefore in the interest of brevity the printing station 12*b* need not be described in detail herein.

Referring to FIG. 2, because the printing cylinders of the printing press 10 may have very similar or identical structures, only one of the printing cylinders, namely the plate cylinder 16*a* is shown in detail and will be described in the following. The plate cylinder 16*a* includes a shaft 17 having a first shaft end 19*a* and a second shaft end 19*b*. The second shaft end 19*b* may be a drive end. The shaft ends 19*a* and 19*b* include shaft end bearing assemblies 36*a* and 36*b*, respectively. Each shaft end bearing assembly 36*a* and 36*b* includes a bearing 34*a* and 34*b*, respectively. Each of the shaft end bearing assemblies 36*a* and 36*b* also includes an eccentric mounting sleeve 30*a* and 30*b*, respectively. Similarly, as shown in FIG. 1, each of the blanket cylinders 18*a* and 18*b* can include an eccentric mounting sleeve 32*a* and 32*b*, respectively.

The shaft end bearing assemblies 36*a* and 36*b* of the plate cylinder 16*a* are mounted to the sub-frame 24 using a split-side retainer 38 (only one retainer 38 is shown in FIG. 2). The retainer 38 may include two halves 38*a*, 38*b*, which, when joined together, form a generally doughnut-shaped retainer. The bearings 34*a* and 34*b* along with the sleeves 30*a* and 30*b* may slide axially relative to the cylinder 16*a* to permit installation of the cylinder 16*a* on the sub-frame 24. The retainers 38 serve to properly position the bearings axially on the cylinder 16*a* and to secure the sleeves 30*a* and 30*b* to the sub-frame 24.

The sub-frame 24 is configured to permit the print cylinders to swing between the two configurations shown in FIG. 2. For example, the sub-frame 24 may include an appropriate slot 40 sized to permit the eccentric sleeve 30*a* and the bearing 34*a* to be moved out of the sub-frame 24 as shown in FIG. 2. Thus, when the sleeves 30*a*, 30*b* and/or the bearings 34*a*, 34*b* are shifted toward the center of the cylinder 16*a*, the ends 19*a*, 19*b* may be positioned through the bores 39*a* and 39*b*, and possibly through the bores 37*a* and 37*b*, thus allowing the cylinder 16*a* to be positioned as shown in FIG. 2. Subsequently, the sleeves and the bearings are shifted outwardly such that they may be mounted to the sub-frame 24 and secured using the retainer 38.

In accordance with disclosed example, wherein the printing press 10 is an existing printing press 10, the printing press 10 may be converted from its original printing length to a different print length, while the frame 14 of the printing press 10, the main drive train (not shown), the ink roller train 20*a* and 20*b*, and the dampening systems 22*a* and 22*b* remain essentially intact. In other words, those systems in place on the printing press 10 prior to incorporating the apparatus of the present disclosure need not be replaced. Therefore, modifying an existing printing press 10 in accordance with the teachings of the present disclosure saves significantly on the cost of dismantling, shipping, and assembly, and a significant amount of parts, systems, and sub-structures remain in place and/or are reused after the printing press has been modified with the new printing length/cutoff. Further, most if not all of the electrical wiring, piping and ducting in place on the existing printing press may also remain undisturbed.

In accordance with the disclosed examples, to modify the existing printing press 10 from its original print length to a different print length, the sub-frame 24 having the sides 24*a* and 24*b* may be mounted on the existing frame 14 of the printing press 10. Prior to mounting the sub-frame 24 to the frame 14, however, the print cylinders of the frame 14, which are all sized to provide the first print length, are removed from the frame 14. The sides 24*a* and 24*b* of the sub-frame can be mounted to the sides 14*a* and 14*b*, respectively, of the frame 14. The sides 24*a* and 24*b* of the sub-frame 24 may be located precisely both vertically and horizontally and relative to each other, using the above described datum surfaces 28*a* and 28*b*. The sides 24*a* and 24*b* of the sub-frame 24 may be suitably fastened to the corresponding sides 24*a* and 24*b* of the frame 24 with pins, bolts or other types of fasteners.

When the sub-frame 24 is mounted to the frame 14, the bores 39*a* and 39*b* of the sub-frame 24 may align with the bores 37*a* and 37*b* of the frame 24, respectively. However, the bores 39*a* and 39*b* may not align concentrically with the bores 37*a* and 37*b* of the frame 14. In other words, the common bore axis 60 of the bores 39*a* and 39*b* may not align with the common bore axis 60 of the corresponding bores 37*a* and 37*b*. Accordingly, when the print cylinders having a print length of the second size are mounted on the sub-frame 24, the shaft end bearing assemblies 36*a* and 36*b* of the print cylinders are operatively mounted in the bores 39*a* and 39*b* of the sub-frame 24. However, because the bores 39*a* and 39*b* of the sub-frame 24 may be aligned with the bores 37*a* and 37*b* of the frame 14, the shaft ends 19*a* and 19*b* of the print cylinders can extend into the bores 37*a* and 37*b* of the frame 14. As shown in FIG. 2, such extension of the shaft end 19*b* may be necessary since the shaft end 19*b* is the driven end of the shaft 17 and may be connected to a drive source.

After the sub-frame 24 is mounted to the frame 14, the printing cylinders having the second print length can be mounted to the sub-frame 24 as shown in FIG. 2. Each print cylinder can be mounted in the sub-frame 24 by first inserting the second shaft end 19*b* in the bore 39*b* of the sub-frame 24. It may be necessary, however, to first slide the bearing assemblies 36*a* and 36*b* toward the center of the print cylinder. The first shaft end 19*a*, which includes the bearing assembly 36*a* can be swung into the bore 39*a* through the slot 40, as described above. The bearing assemblies 36*a* and 36*b* can be moved outward from the center of the printing cylinder and positioned in the bores 39*a* and 39*b*, respectively. The eccentric sleeves 30*a* and 30*b* can then be adjusted to provide the proper operative coupling between the printing cylinders. The split retainer 38 may then be installed over the bearing assembly 36*a* and bolted to the appropriate eccentric mounting sleeve 30*a* in order to properly locate the bearing 34*a* within the sleeve 30*a*. A separate retainer (not shown) may be installed at the opposite end of the cylinder to hold the bearing 34*b* and the sleeve 30*b* at the shaft end 19*b* in place in a similar manner.

In accordance with another aspect of the disclosed example, much if not all of the main drive (not shown) may be retained intact or nearly intact. New gearing appropriate for the new cylinders may be provided as needed. Adapter plates and/or eccentric sleeves/studs may be used to reposition gears to accommodate the position of the existing main drive gear.

In accordance with yet another aspect of the disclosed example, a printing press 10 can be provided with a number of sub-frames 24. Each sub-frame 24 can include a plurality of bores that can support print cylinders having a print length that is different than the print length of the existing printing press 10 and the other sub-frames 24. Accordingly, the printing press 10 is readily adaptable for conversion to different printing lengths in accordance with the number of sub-frames 24 provided. Each sub-frame 24 can be mounted to the frame 14 of the printing press 10 as described in the foregoing to change the print length of the printing press 10.

Numerous modifications and alternative embodiments of the invention will be apparent to those skilled in the art in view of the forgoing description. Accordingly, this description is to be construed as illustrative only and is for the purpose of teaching those skilled in the art the best mode of carrying out the invention. The details of the system may be varied substantially without departing from the spirit of the invention, and the exclusive use of all modifications which are within the scope of the claims is reserved.

What is claimed is:

1. A sub-frame for use with a frame of a printing press, the frame of the printing press having cylinder mounting bores, the sub-frame comprising:

a first sub-frame side having a plurality of bores and mountable to the printing press frame;

a second sub-frame side having a plurality of bores and mountable to the printing press frame spaced from the first sub-frame side, each bore of the first sub-frame side and a corresponding one of the bores of the second sub-frame side alignable along a common bore axis to support a printing cylinder;

at least some of the bores of the first and second sub-frame sides disposed on the sub-frame sides so as to be offset relative to a pair of aligned mounting bores on the printing press frame when the first sub-frame side and the second sub-frame side are mounted to the printing press frame; and at least one of the bores of the first and second sub-frame sides disposed on the sub-frame sides is arranged relative to at least one of the mounting bores on the printing press frame so as to permit a drive end of the printing cylinder to extend through the at least one bore on the sub-frame and the at least one mounting bore on the printing press frame when the printing cylinder is mounted to the sub-frame.

2. The sub-frame of claim 1, wherein the first sub-frame side and the second sub-frame side provide support for a plurality of operatively coupled printing cylinders having different sizes relative to a plurality of operatively coupled printing cylinders being supportable by the frame.

3. The sub-frame of claim 1, wherein the first sub-frame side and the second sub-frame side are mounted to the frame by being aligned with a generally horizontal datum surface and a generally vertical datum surface of the frame.

4. The sub-frame of claim 1, wherein the first sub-frame side and the second sub-frame side are mountable to the frame using a means for aligning the sub-frame with the frame.

5. The sub-frame of claim 1, wherein the first sub-frame side and the second sub-frame side are fastened to the frame with a plurality of fasteners.

6. The sub-frame of claim 1, wherein each bore of the first sub-frame side includes a slot connecting the bore to an outside of the sub-frame, and wherein the slot is sized to provide mounting of a shaft end bearing assembly of a printing cylinder from the outside of the sub-frame into the bore through the slot and removal of the shaft end bearing assembly from the bore to the outside of the sub-frame through the slot.

7. The sub-frame of claim 1, the printing cylinder including a first bearing assembly supportable in a bore of the first sub-frame side and a second bearing assembly supportable in the corresponding bore of a second sub-frame side, wherein the first bearing assembly and the second bearing assembly are shiftable toward a center of the printing cylinder.

8. The sub-frame of claim 7, each of the first bearing assembly and the second bearing assembly comprising a bearing disposed in a sleeve to provide rotation of the printing cylinder relative to the sleeve, wherein the sleeve is eccentric relative to shaft of the print cylinder.

9. The sub-frame of claim 7, the printing cylinder comprising a retainer to securely retain at least one of the first bearing assembly or the second bearing assembly in a corresponding bore of the sub-frame.

10. A method of using a plurality of print cylinders of a second size in a printing press having a plurality of print cylinders of a first size, the method comprising:

removing the print cylinders of the first size from a frame, the frame having a plurality of spaced apart frame bores, each pair of spaced apart frame bores having a common bore axis to support and operatively couple the print cylinders of the first size;

mounting a sub-frame to the frame, the sub-frame including a plurality of spaced apart sub-frame bores, each pair of spaced apart sub-frame bores having a common bore axis to support and operatively couple the print cylinders of the second size; wherein at least one of the sub-frame bores and at least one of the frame bores are disposed to permit a drive end of the selected one of the print cylinders to extend through the at least one sub-frame bore and the at least one frame bore when the selected print cylinder is mounted to the sub-frame; and mounting each of the print cylinders of the second size in the sub-frame, the mounting including mounting shaft end bearing assemblies of each print cylinder of the second size in a pair of the spaced apart bores of the sub-frame, wherein one or both of the shaft end bearing assemblies are arranged to be shiftable toward and away from one another when mounted to the print cylinder of the second size.

11. The method of claim 10, the mounting of the sub-frame to the frame comprising aligning the sub-frame with the frame and fastening the sub-frame to the frame.

12. The method of claim 10, the mounting of the sub-frame to the frame comprising mounting a first sub-frame side to a first frame side and mounting a second sub-frame side to a second frame side.

13. The method of claim 10, the mounting of each of the print cylinders of the second size in the sub-frame comprising mounting one of the shaft end bearing assemblies of each print cylinder of the second size in a bore of the first sub-frame side through a slot connecting the bore to an outside of the sub-frame.

14. The method of claim 10, the mounting of each of the print cylinders of the second size in the sub-frame comprising mounting one of the shaft end bearing assemblies of each print cylinder of the second size in a bore of the sub-frame through a slot connecting the bore to an outside of the sub-frame.

* * * * *